US006161973A

United States Patent [19]

Kawamura et al.

[11] Patent Number: 6,161,973

[45] Date of Patent: Dec. 19, 2000

[54] INK-JET IMAGE FORMING DEVICE

[75] Inventors: Iwao Kawamura, Tokyo; Kiyokazu Namekata, Kanagawa; Kazuhiro Murakami, Tokyo; Kazuhiro Nishimura, Tokyo; Ryoma Suzuki, Tokyo; Kensuke Izuma, Tokyo; Naoki Kiyohara, Tokyo; Satoru Sasame, Tokyo, all of Japan

[73] Assignee: Copyer Co., Ltd., Tokyo, Japan

[21] Appl. No.: 09/101,415

[22] PCT Filed: Jan. 21, 1997

[86] PCT No.: PCT/JP97/00114

§ 371 Date: Jul. 10, 1998

§ 102(e) Date: Jul. 10, 1998

[87] PCT Pub. No.: WO97/27055

PCT Pub. Date: Jul. 31, 1997

[30] Foreign Application Priority Data

| | | | |
|---|---|---|---|
| Jan. 22, 1996 | [JP] | Japan | 8-026255 |
| Mar. 4, 1996 | [JP] | Japan | 8-045711 |
| Mar. 5, 1996 | [JP] | Japan | 8-047834 |
| May 31, 1996 | [JP] | Japan | 8-139056 |

[51] Int. Cl.[7] ..... B41J 11/42

[52] U.S. Cl. ..... 400/582; 400/608

[58] Field of Search ..... 400/582, 608, 400/608.1, 618

[56] References Cited

U.S. PATENT DOCUMENTS

| | | | |
|---|---|---|---|
| 4,642,659 | 2/1987 | Yamaguchi | 346/76 |
| 5,308,176 | 5/1994 | Yamaguchi | 400/618 |
| 5,455,604 | 10/1995 | Adams et al. | 346/138 |
| 5,646,668 | 7/1997 | Fujioka et al. | 347/104 |

*Primary Examiner*—John S. Hilten
*Assistant Examiner*—Charles H. Nolan, Jr.
*Attorney, Agent, or Firm*—Dellett and Walters

[57] ABSTRACT

A first position control member, which presses a recording sheet between a sheet conveyance roller 28*c* and an image forming area, is disposed and a second position control member, which presses the recording sheet between the image forming area and a spur 42, is disposed. Thus, of the recording sheet in the course of conveyance, a portion located at the image forming area is pressed and stretched by the first position control member 34 and the second position control member 38, and an interval between this portion and an ink ejection surface is maintained at a predetermined distance. Accordingly, even if ink ejected from the ink ejection outlets is absorbed into the recording sheet, so that a fiber of the recording sheet expands, no unevenness is formed on the recording sheet. Therefore, it is possible to suppress the cocking.

14 Claims, 10 Drawing Sheets

INK-JET IMAGE FORMING DEVICE

TECHNICAL FIELD

The present invention relates to an image forming apparatus employing an ink-jet system in which ink is ejected from a print head to form an image on a recording medium such as a recording sheet.

BACKGROUND ART

There is known, as one of output devices of computers and workstations, an image forming apparatus employing an ink-jet system in which ink is ejected from a print head to form an image on a recording medium such as a recording sheet. The image forming apparatus employing an ink-jet system comprises, for example, a print head having an ink ejection surface on which a plurality of ink ejection outlets each for ejecting ink are formed, a carriage on which the print head is mounted, said carriage reciprocating in a predetermined direction, and a recording paper conveying device for conveying recording papers in a direction (a recording sheet conveying direction) perpendicular to the predetermined direction.

In the event that an image is recorded on a recording sheet, the recording sheet in the course of conveyance by the recording sheet conveying device is temporarily stopped, and while the carriage is reciprocated in the predetermined direction, ink is ejected from the ink ejection outlets in accordance with an image signal having image information to form (print) a band of image on a portion located at an image formation area of the recording paper facing the ink ejection outlets. Thereafter, the recording paper is fed by a band of width and is stopped, and again while the carriage is reciprocated in the predetermined direction, ink is ejected from the ink ejection outlets in accordance with the image signal to form an image on a new portion located at the image formation area of the recording sheet. Such a performance is repeated and thereby forming an image on the recording sheet in its entirety.

According to such an image forming apparatus employing an ink-jet system, forming an image on a recording sheet through ejection of ink brings about a phenomenon (cockling) in which fibers of the recording sheet absorbing the ink partially expand and whereby unevenness is formed on the expanded portion and its periphery. It happens that unevenness due to the cockling is not only formed on the portion of the recording paper which have been subjected to the image formation through an ink adhesion, but also greatly grows up to the subsequent portion of the recording sheet which is ought to be subjected to the next image formation. In this case, the printing would be carried out on the top portion, the bottom portion and the slant portion of the unevenness. This brings about delicate deviation in a printing position and has a bad effect on an image formation thereby involving degradation of the image quality. Further, there is the possibility that a convex portion of the recording paper is in contact with the print head mounted on the carriage which reciprocates at high speed in the predetermined direction, and as a result portions, such as the ink ejection outlets and the like, which are precisely manufactured, are damaged. Furthermore, there is the possibility that paper powder and the like adheres to the ink ejection outlets and as a result the ink ejection becomes poor thereby involving degradation of the image quality.

As a technology for reducing the cockling, there has been proposed a technology in which a recording paper, that is random in directional properties of fibers, is used so that the recording paper extends in multi-directions, but not in a single direction by ink absorbed in the recording paper. According to this technology, however, the use of the recording sheet is restricted to only a specified recording paper, and the cost is expensive. Further, according to the above-mentioned technology, it is difficult to sufficiently reduce the cockling.

As another technology for reducing the cockling, there has been proposed a technology in which a recording sheet is wound onto a roller having a large diameter and is conveyed, so that a printing is carried out on the recording sheet wound onto the roller. In this case, however, in view of the size of the image forming apparatus in its entirety, there is a limit in the diameter of the roller. For this reason, distances between the recording sheet wound onto the roller and a plurality of ink ejection outlets are varied for each ink ejection outlet. In this case, of the formed image, portions, which are formed by ink ejected from the ink ejection outlets spaced apart from the recording sheet with relatively long intervals, undergo degradation of the image quality, and further it is difficult to expect a printing on a straight line basis. Furthermore, in this case, it is difficult to convey thick recording sheets, high rigidity of recording sheets, etc.

As still another technology for reducing the cockling, there has been proposed a technology referred to as a multi-scanning scheme in which a printing is performed on a recording sheet in such a manner that a carriage is reciprocated (scanned) over and over on the same plane (the same band) so that ink is ejected on the same plane of the recording sheet little by little on a divisional basis. According to this technology, however, the carriage is scanned on the same plane several number of times, and thus it takes a lot of time by the correspondence.

In view of the foregoing, it is an object of the present invention is to provide an image forming apparatus employing an ink-jet system, which is capable of preventing a damage for a print head due to the cockling and contributes to an improvement of an image quality.

DISCLOSURE OF THE INVENTION

The present invention has been made to attain the above-mentioned object and is to provide a first image forming apparatus employing an ink-jet system wherein a carriage, which has an ink ejection surface on which a plurality of ink ejection outlets each ejecting ink are formed, is reciprocated in a predetermined direction, while a recording sheet is conveyed in a direction intersecting the predetermined direction, and ink is ejected from the ink ejection outlets onto a portion of the recording sheet, which portion is located at an image forming area in front of the ink ejection surface, in accordance with image information to form an image, said image forming apparatus comprising:

(1) a first conveyance member for conveying the recording sheet while supporting the recording sheet, said first conveyance member being disposed at an upper stream with respect to a recording sheet conveyance direction than the image forming area;

(2) a second conveyance member for conveying the recording sheet while supporting the recording sheet, said second conveyance member being disposed at a down stream with respect to the recording sheet conveyance direction than the image forming area;

(3) a first position control member for controlling a position of the recording sheet by pressing either one of both surfaces of the recording sheet, said first position control member being disposed between said first conveyance member and the image forming area; and (4) a second position control member for controlling a position of the recording sheet by pressing either one of both surfaces of the recording sheet, so that the portion of the recording sheet, which portion is located at the image forming area, is stretched in cooperation with said first position control member and an interval between said portion of the recording sheet and the ink ejection surface is maintained at a predetermined distance, said second position control member being disposed between said image forming area and said second conveyance member.

In the first image forming apparatus employing an ink-jet system, it is preferable that (5) both said first position control member and said second position control member extend in the predetermined direction.

Further, in the first image forming apparatus employing an ink-jet system, it is preferable that (6) at least one of said first position control member and said second position control member is a line shaped shaped one spread in the predetermined direction.

To attain the above-mentioned object, there is provided a second image forming apparatus employing an ink-jet system wherein a carriage, which has an ink ejection surface on which a plurality of ink ejection outlets each ejecting ink are formed, is reciprocated in a predetermined direction, while a recording sheet is conveyed in a direction intersecting the predetermined direction, and ink is ejected from the ink ejection outlets onto a portion of the recording sheet, which portion is located at an image forming area in front of the ink ejection surface, in accordance with image information to form an image, said image forming apparatus comprising:

(7) a first conveyance member for conveying the recording sheet while supporting the recording sheet, said first conveyance member being disposed at an upper stream with respect to a recording sheet conveyance direction than the image forming area;

(8) a second conveyance member for conveying the recording sheet while supporting the recording sheet, said second conveyance member being disposed at a down stream with respect to the recording sheet conveyance direction than the image forming area;

(9) a first position control member for controlling a position of the recording sheet by pressing either one of both surfaces of the recording sheet, said first position control member being disposed between said first conveyance member and the image forming area; and

(10) a second position control member for controlling a position of the recording sheet by pressing either one of both surfaces of the recording sheet, so that the portion of the recording sheet, which portion is located at the image forming area, is stretched in cooperation with said first position control member and an interval between said portion of the recording sheet and the ink ejection surface is maintained at a predetermined distance, said second position control member being disposed between said image forming area and said second conveyance member,

(11) wherein a position in which the first conveyance member supports the recording sheet is located at a position which is higher than the first position control member, and a position in which the second conveyance member supports the recording sheet is located at a position which is lower than the second position control member or the same height as the second position control member.

In the second image forming apparatus employing an ink-jet system, it is preferable that

(12) the first position control member presses, of both the surfaces of the recording sheet, a surface facing the ink ejection surface, and

(13) the second position control member presses, of both the surfaces of the recording sheet, a surface opposite to the surface facing the ink ejection surface.

To attain the above-mentioned object, there is provided a third image forming apparatus employing an ink-jet system wherein a carriage, which has an ink ejection surface on which a plurality of ink ejection outlets each ejecting ink are formed, is reciprocated in a predetermined direction, while a recording sheet is conveyed in a direction intersecting the predetermined direction, and ink is ejected from the ink ejection outlets onto a portion of the recording sheet, which portion is located at an image forming area in front of the ink ejection surface, in accordance with image information to form an image, said image forming apparatus comprising:

(14) a first conveyance member for conveying the recording sheet while supporting the recording sheet, said first conveyance member being disposed at an upper stream with respect to a recording sheet conveyance direction than the image forming area;

(15) a second conveyance member for conveying the recording sheet while supporting the recording sheet, said second conveyance member being disposed at a down stream with respect to the recording sheet conveyance direction than the image forming area;

(16) a first position control member for controlling a position of the recording sheet by pressing either one of both surfaces of the recording sheet, said first position control member being disposed between said first conveyance member and the image forming area; and

(17) a second position control member for controlling a position of the recording sheet by pressing either one of both surfaces of the recording sheet, so that the portion of the recording sheet, which portion is located at the image forming area, is stretched in cooperation with said first position control member and an interval between said portion of the recording sheet and the ink ejection surface is maintained at a predetermined distance, said second position control member being disposed between said image forming area and said second conveyance member,

(18) wherein positions in which the first conveyance member and the second conveyance member support the recording sheet, respectively, are located at positions which are lower than the first position control member and the second position control member, respectively.

In the third image forming apparatus employing an ink-jet system, it is preferable that

(19) both the first position control member and the second position control member press, of both the surfaces of the recording sheet, a surface opposite to the surface facing the ink ejection surface.

Further, in the third image forming apparatus employing an ink-jet system, it is preferable that

(20) at least one of said first position control member and said second position control member is a line-like shaped one.

To attain the above-mentioned object, there is provided a fourth image forming apparatus employing an ink-jet system wherein a carriage, which has an ink ejection surface on which a plurality of ink ejection outlets each ejecting ink are formed, is reciprocated in a predetermined direction, while a recording sheet is conveyed in a direction intersecting the predetermined direction, and ink is ejected from the ink ejection outlets onto a portion of the recording sheet, which portion is located at an image forming area in front of the ink ejection surface, in accordance with image information to form an image, said image forming apparatus comprising:

(21) a first conveyance member for conveying the recording sheet while supporting the recording sheet, said first conveyance member being disposed at an upper stream with respect to a recording sheet conveyance direction than the image forming area;

(22) a second conveyance member for conveying the recording sheet while supporting the recording sheet, said second conveyance member being disposed at a down stream with respect to the recording sheet conveyance direction than the image forming area;

(23) a fine line shape configuration of first position control member for controlling a position of the recording sheet by pressing either one of both surfaces of the recording sheet, said first position control member being disposed between said first conveyance member and the image forming area;

(24) a fine line shape configuration of second position control member for controlling a position of the recording sheet by pressing either one of both surfaces of the recording sheet, so that the portion of the recording sheet, which portion is located at the image forming area, is stretched in cooperation with said first position control member and an interval between said portion of the recording sheet and the ink ejection surface is maintained at a predetermined distance, said second position control member being disposed between said image forming area and said second conveyance member; and

(25) a horizontality ensuring member for adjust a position of the second position control member so that a portion of the recording sheet, which portion is located at the image forming area, is kept parallel to the ink ejection surface, said horizontality ensuring member being detachably fixed on said second position control member.

In the fourth image forming apparatus employing an ink-jet system, it is preferable that each of said first position control member and said second position control member has a curved surface pressing the recording sheet.

To attain the above-mentioned object, there is provided a fifth image forming apparatus employing an ink-jet system comprising a print head having ink ejection outlets each for ejecting ink, and a carriage on which said print head is mounted, said carriage reciprocating in a predetermined direction, wherein a recording sheet is fed to an image forming area facing the ink ejection outlets, and ink is ejected from the ink ejection outlets onto the recording sheet, while said carriage reciprocates in the predetermined direction, said image forming apparatus comprising:

(26) a recording medium floating prevention member disposed in the more upward stream with respect to a recording sheet conveyance direction than the ink ejection outlet and in the vicinity of the ink ejection outlet, said recording medium floating prevention member being closer to the recording sheet as compared with the print head.

In the fifth image forming apparatus employing an ink-jet system, it is preferable that

(27) a portion of the recording medium floating prevention member, which portion faces the recording sheet, is formed with smoothness.

Further, in the fifth image forming apparatus employing an ink-jet system, it is preferable that

(28) the recording medium floating prevention member is made of polyoxymethylene or fluororesin. Polyoxymethylene is called the polyacetal resin and is tough plastics.

Furthermore, in the fifth image forming apparatus employing an ink-jet system, it is acceptable that

(29) the recording medium floating prevention member is formed on the print head.

Still further, in the fifth image forming apparatus employing an ink-jet system, it is preferable that

(30) the recording medium floating prevention member is formed on the carriage.

BRIEF DESCRIPTION OF THE DRAWINGS

FIG. 5(*b*) is a typical illustration showing a positional relation in the event that the first position control member presses on the upside of the recording sheet, while the second position control member presses on the underside of the recording sheet; FIG. 5(*c*) is a typical illustration showing a positional relation in the event that the first position control member presses on the underside of the recording sheet, while the second position control member presses on the upside of the recording sheet; and FIG. 5(*d*) is a typical illustration showing a positional relation in the event that both the first and second position control members press on the underside of the recording sheet.

BEST MODE FOR CARRYING OUT THE INVENTION

Figure 1:
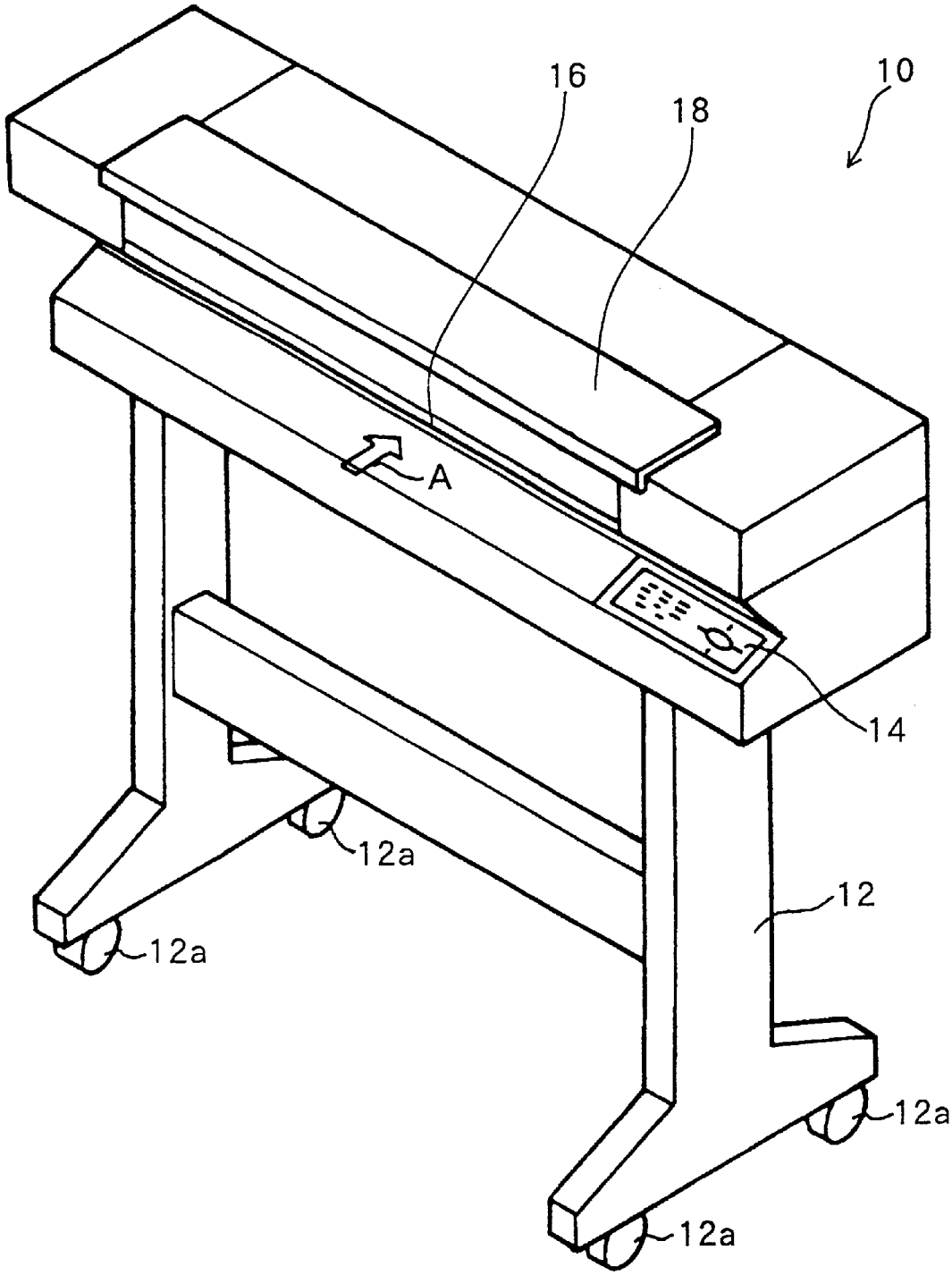
FIG. 1 is a perspective view showing a schematic construction of a plotter according to a first embodiment of an image forming apparatus employing an ink-jet system of the present invention.

Hereinafter, embodiments of an image forming apparatus employing an ink-jet system of the present invention will be described with reference to the drawing.

A plotter 10 according to the first embodiment shown in FIG. 1 is fixed on the top of a stand 12 equipped with casters 12*a*. The plotter 10 has an operation unit 14 for operating the plotter 10. Operating various types of switches and the like provided on the operation unit 14 permits instructions for a sheet size, on-line/off-line, a command, etc. A recording sheet, which is inserted into a recording sheet insertion inlet 16 from an arrow A direction, is conveyed into the inside of the plotter 10 in accordance with an instruction issued from the operation unit 14, and is discharged after printing for an image. The plotter 10 has also a cover 18 for covering the inside of the plotter 10.

Figure 2:
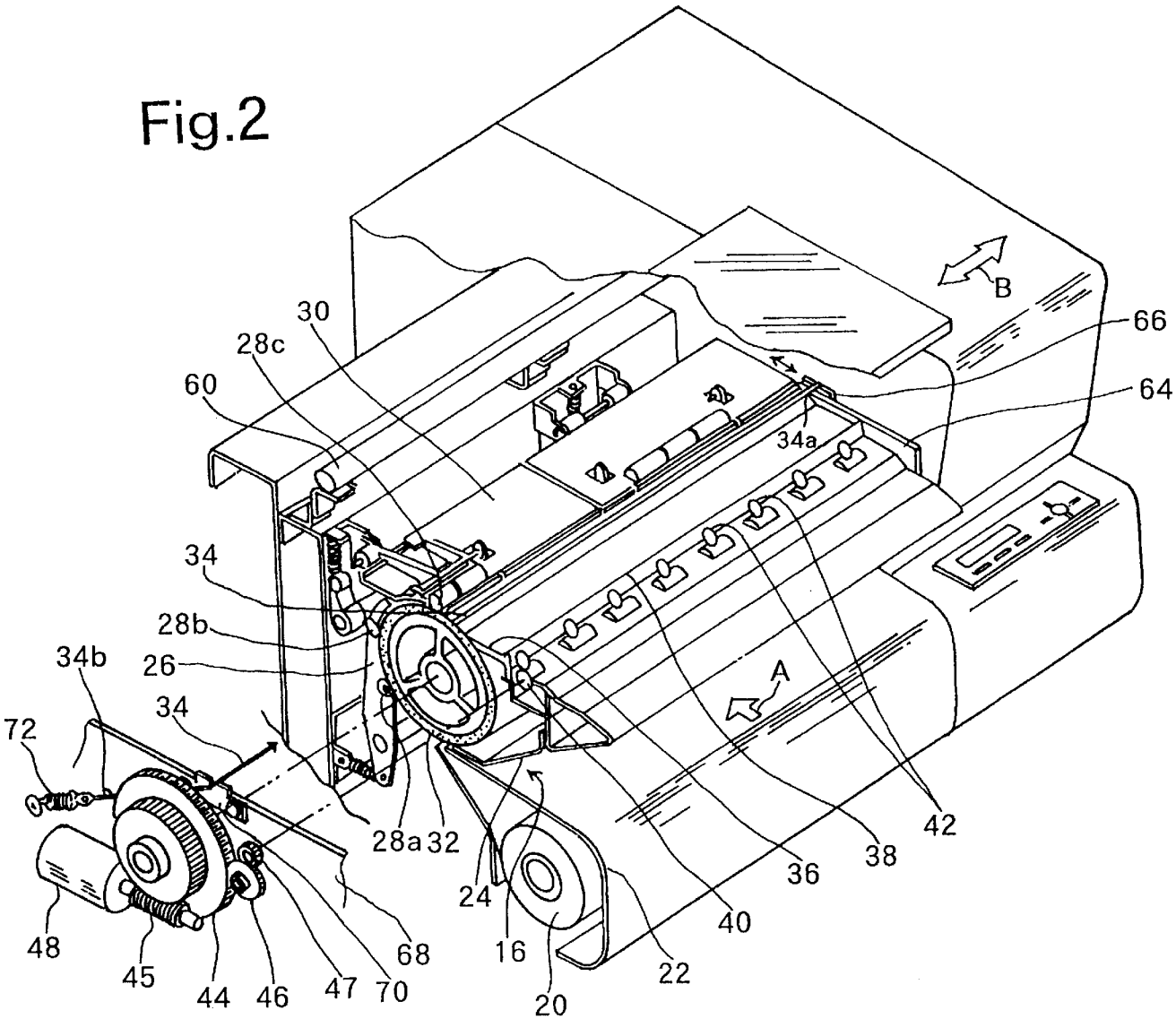
FIG. 2 is a perspective view of a conveyance path from an insertion of a recording sheet to a discharge of the recording sheet in the plotter shown in FIG. 1.

Next, there will be described a conveyance path for recording sheets with reference to FIG. 2.

The plotter 10 may perform a printing selectively either on a recording sheet inserted from the recording sheet insertion inlet 16 and a recording sheet (a rolled sheet 20) wound as a roll. Here, there will be described a conveyance path for recording sheets inserted from the recording sheet insertion inlet 16.

A recording sheet (for example, a large-sized cut sheet) is regularly placed on a cover 22 for the rolled sheet 20 and is inserted into the recording sheet insertion inlet 16 from an arrow A direction. The recording sheet inserted passes between the cover 22 and an upper guide 24 and across a first position control member 34 to reach a printing region (an example of an image forming area referred to in the present invention) above a print board 36, while being supported by sheet conveyance rollers 28*a* and 28*b* mounted on a lower conveyance roller supporting plate 26 and a sheet conveyance roller 28*c* mounted on an upper conveyance roller supporting plate 30, and a driving roller 32 (the sheet conveyance roller 28*c* and the driving roller 32 are an example of a first conveyance member referred to in the present invention).

The recording sheet, which has passed through a second position control member 38 formed on a portion, located at the downward stream end with respect to the recording sheet conveyance direction, of the print board 36, is discharged while being supported by a discharge roller 40 and spurs 42 (the discharge roller 40 and the spurs 42 are an example of a second conveyance member referred to in the present invention). Of the recording sheet being conveyed, part located at the upper portion of the print board 36 is, as will be described later, controlled by the first position control member 34 and the second position control member 38 so that flatness of the recording sheet is maintained. The plotter 10 has gears 44, 45, 46 and 47 and a motor 48 for rotating the driving roller 32 and the discharge roller 40.

Figure 3:
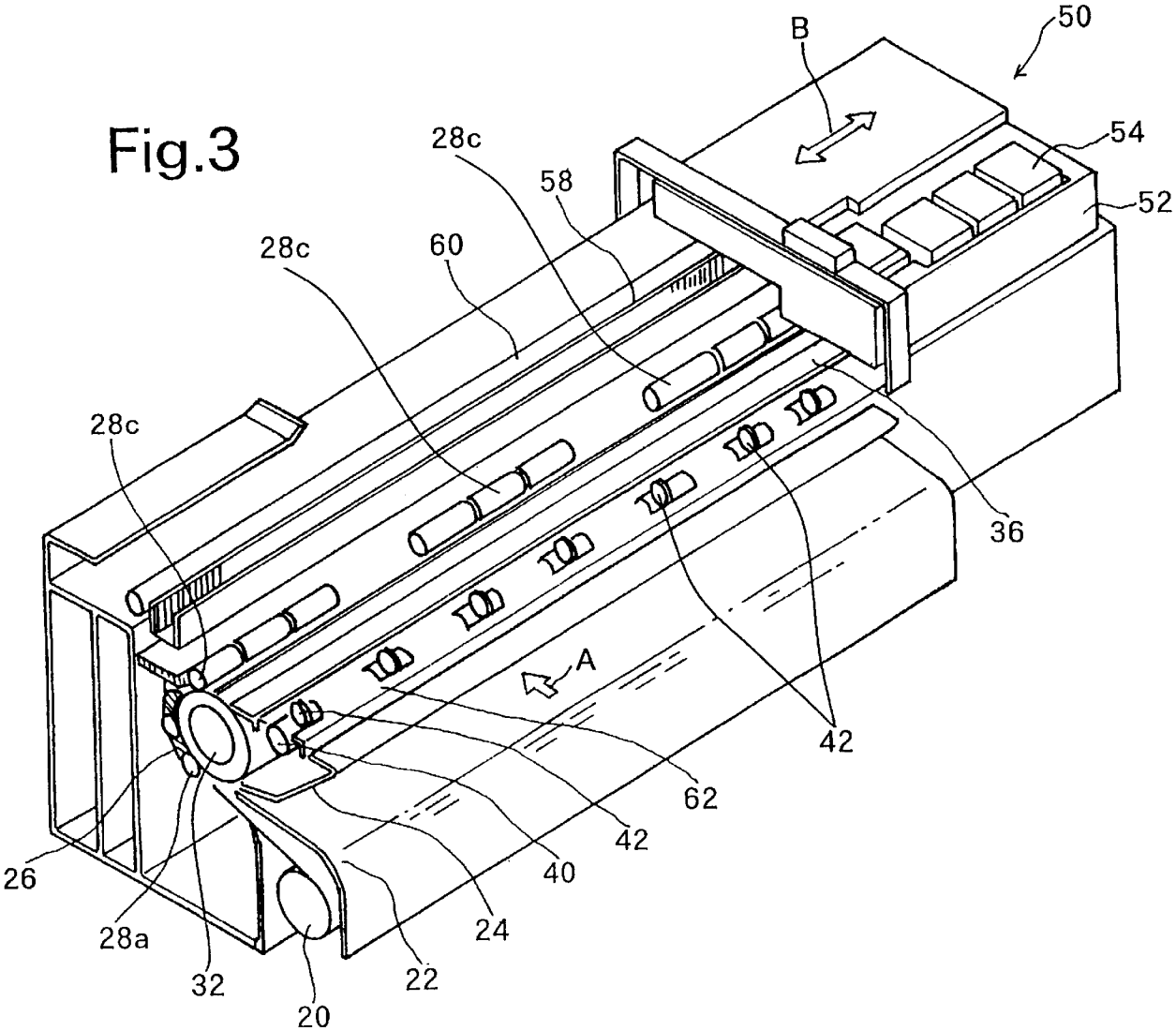
FIG. 3 is a perspective view of a printing section of the plotter shown in FIG. 1.

Next, there will be described a printing process for performing a print on a recording sheet with reference to FIG. 3. In FIG. 3, the same parts are denoted by the same reference numbers as those of FIG. 2.

The print unit has a carriage 50 which reciprocates in an arrow B direction (an example of a predetermined direction referred to in the present invention). The carriage 50 has a head holder 52 on which print heads 54 accommodating color inks (for example, cyan, magenta, yellow and black of inks), respectively, are mounted. On an ink ejection surface 56 (cf. FIG. 4) of each of the print heads 54 there are formed a plurality of ink ejection outlets (not illustrated) each for ejecting ink.

The carriage 50 is fixed on a belt 58 which is coupled with a driving source (not illustrated). The belt 58 reciprocates in an arrow B direction in accordance with a forward-backward rotation of the driving source.

Reciprocation of the belt 58 in the arrow B direction causes the carriage 50 to reciprocate in the arrow B direction in accordance with a guide rail 60.

A recording sheet is intermittently conveyed in a direction (recording sheet conveyance direction) perpendicular to the arrow B direction. When an image is formed on the recording sheet, the recording sheet is temporarily stopped, and while the carriage 50 reciprocates in the arrow B direction, ink is ejected from the ink ejection outlets in accordance with image information applied to the print heads 54 onto a portion, of the recording sheet, which portion is located at an image forming area formed in front of an ink ejection face 56 (cf. FIG. 4). Thereafter, the recording sheet is conveyed by a predetermined length so that a subsequent band of image is formed on a new portion of the recording sheet, which is located at the image forming area. This operation is repeated throughout the overall length of the recording sheet. Thus, a color image is formed on the recording sheet. The recording sheet on which the color image is formed is discharged along a discharge guide 62 while being supported by the discharge roller 40 and the spurs 42.

Figure 4:
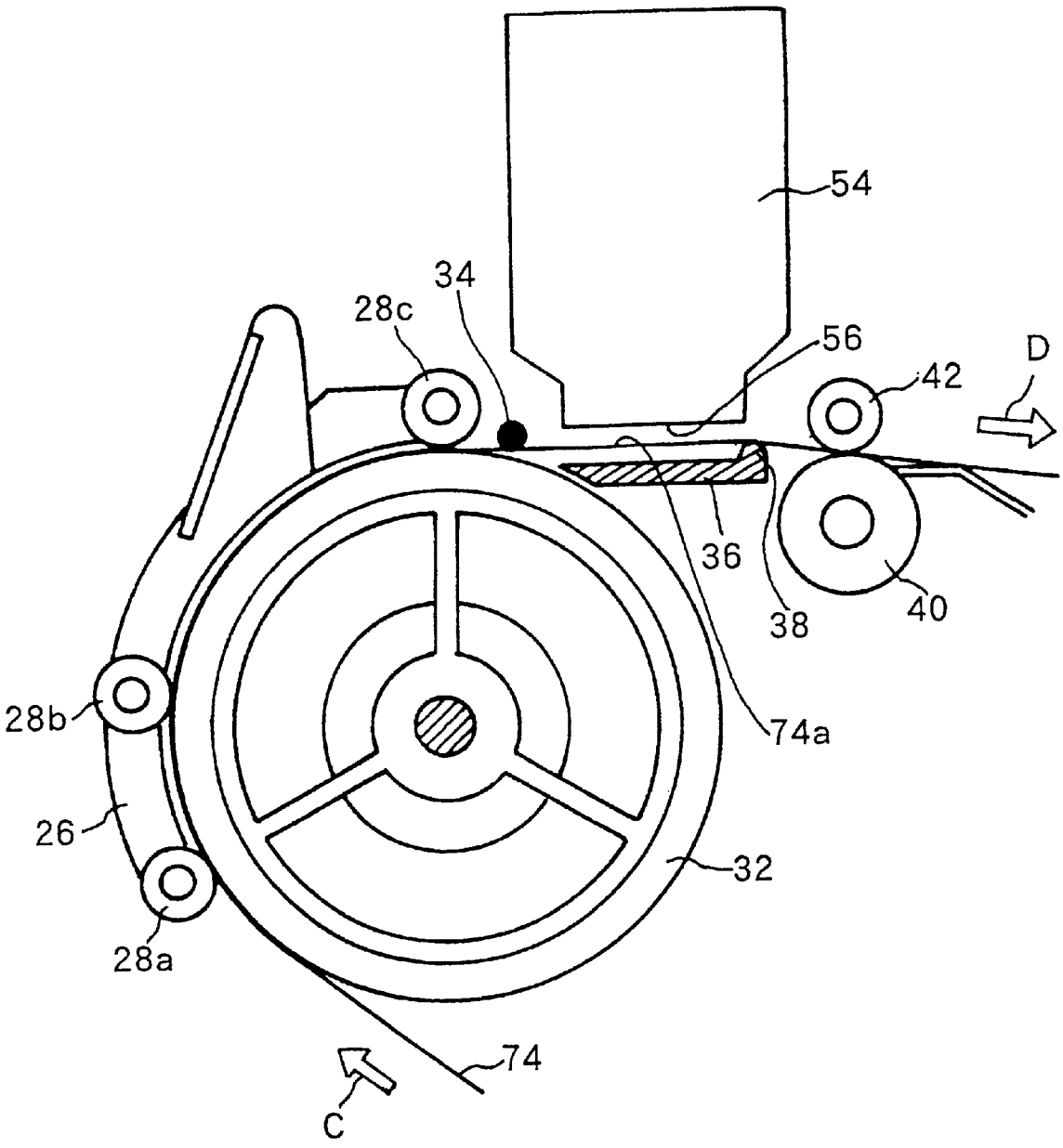
FIG. 4 is a cross-sectional view of a first position control member and a second position control member showing in FIG. 2.

Next, there will be described the first position control member 34 and the second position control member 38 with reference to FIG. 2 and FIG. 4. In FIG. 4, the same parts are denoted by the same reference numbers as those of FIG. 2 and FIG. 3.

The first position control member 34 and the second position control member 38 extend in the arrow B direction (direction perpendicular to the recording sheet conveyance direction). The first position control member 34 consists of a line-shaped member and offers such a state that it is stretched. As shown in FIG. 2, one end 34*a* of the first position control member 34 is fixed to a right side plate 64 through a right position plate 66 which is fixed on the right side plate 64 in such a manner that the one end 34*a* is movable in the recording sheet conveyance direction. On the other hand, another end 34*b* of the first position control member 34 is connected to a spring 72 through a cut-out of a left position plate 70 which is fixed on the left side plate 68 in such a manner that the another end 34*b* is movable in the recording sheet conveyance direction. Thus, the first position control member 34 is fixed in the state that a given tension is applied thereto. In this manner, applying a given tension to the first position control member 34 ensures an exact linearity. In the event that the first position control member 34 expands due to changes in the temperature of environment, frictional heat and the like, the corresponding expansion may be absorbed by the spring 72. A position of the first position control member 34 is adjusted in such a manner that the right position plate 66 and the left position plate 70 are moved so that the first position control member 34 is parallel to the guide rail 60 (cf. FIG. 3).

On the other hand, the second position control member 38 is formed on a portion, of the print board 36, located at the downward stream end with respect to the recording sheet conveyance direction, and extends in the arrow B direction and is parallel to the guide rail 60 and the first position control member 34. In this manner, the guide rail 60, the first position control member 34 and the second position control member 38 are arranged to be parallel to one another. Thus a recording sheet, which is conveyed through supporting by the driving roller 32 and the sheet conveyance roller 28*c*, is controlled in its position through being pressed by the lower portion of the first position control member 34 and through being pressed by the upper portion of the second position control member 38. This feature makes it possible, as shown in FIG. 4, to maintain the interval between the ink ejection surface 56 and a portion 74*a* (upper surface) of a recording sheet 74 constant, the portion 74*a* being located at the image forming area, regardless of a moving position of the print head 54, thereby obtaining a good quality of image.

Incidentally, as shown in FIG. 4 in detail, the recording sheet 74 is conveyed from an arrow C direction in such a manner that the recording sheet 74 is pressed by the sheet conveyance rollers 28*a,* 28*b* and 28*c* and is wound around the driving roller 32. The recording sheet 74 passed through the sheet conveyance roller 28*c* is conveyed while the upper surface of the recording sheet 74 is pressed by the first position control member 34 from the upper side. Further, the recording sheet 74 passed through the image forming area is subjected to printing in the image forming area by the print heads 54 while the lower surface of the recording sheet 74 is pressed by the second position control member 38 from the lower side.

As the first position control member 34, a metallic single wire and fine lines in which wires are twisted may be used. In order to reduce a sliding sound due to sliding with a recording sheet, it is acceptable to use wires which are subjected to a coating treatments of resin such as Nylon and Teflon. The second position control member 38 is made of a mold material, a sheet metal, etc., since the linearity is required for the second position control member 38. It is noted that according to experiments, a metallic round bar is preferable.

As mentioned above, the recording sheet 74 is conveyed through supporting by the driving roller 32 and the sheet conveyance rollers 28*a,* 28*b* and 28*c,* while the upper surface of the recording sheet 74 is pressed by the first position control member 34 and the lower surface of the recording sheet 74 is pressed by the second position control member 38. Further, the recording sheet 74 is conveyed through supporting by the discharge roller 40 and the spur 42, and then discharged in an arrow D direction. Accordingly, of the recording sheet 74 on the way of conveyance, the portion 74*a* located at the image forming area in front of the ink ejection surface 56 (upside of the print board 36) is pulled by the first position control member 34 and the second position control member 38. Consequently, even if ink ejected from ink ejection outlets (not illustrated) is absorbed into the recording sheet 74 so that fibers of the recording sheet 74 are expanded, no unevenness is almost formed on the recording sheet 74 and thereby suppressing the cockling. Further, of the recording sheet 74 on the way of conveyance, the portion 74*a* located at the image forming area is pulled by the first position control member 34 and the second position control member 38 so as to offer a plane. Thus, even if a large-sized recording sheet is used, it is possible to maintain the interval between the surface of the recording sheet located at the image forming area and the ink ejection surface 56 at a predetermined distance, and thus it is possible to perform a good printing.

Here, since there is used a line shaped member as the first position control member 34, there is no need to consider an eccentricity as in the event that the roller is used. Thus, not only a design becomes easier, but also a narrower space for mounting can be used. Further, the line-shaped member is pulled through utilization of the side board of the main frame of the apparatus. This feature makes it possible to easily ensure the linearity of the line-shaped member, and thus even in the event that the printing is performed on a large-sized recording sheet, it is possible to ensure flatness of the recording sheet. Further, in the event that a flexibility of line-shaped member is used, an impact such as a fall and a vibration involves no changes in the mounting position, and thus it is possible to maintain the line-shaped member with great accuracy.

Further, since the first position control member 34 consists of the fine line-like shaped member, it does not occupy a great deal of space. This feature permits the first position control member 34 to approach the print heads 54. Consequently, it is possible to shorten a distance between the first position control member 34 and the second position control member 38, so that the surface of the recording sheet located at the image forming area offers a great accuracy of plane, and thereby obtaining a good image. Incidentally, the the first position control member 34 and the second position control member 38 may be adjusted in their position upward and downward in accordance with the thickness of the recording sheet 74. This feature makes it possible to obtain a good image even if the thickness of the recording sheet 74 varies.

Next, referring to FIG. 5, there will be explained a positional relationship among a position (first conveyance site) in which a recording sheet is supported by the driving roller 32 and the sheet conveyance roller 28*c,* a position in which the first position control member 34 is in contact with the recording sheet 74, a position (second conveyance site) in which the recording sheet 74 is supported by the discharge roller 40 and the spur 42, and a position in which the second position control member 38 is in contact with the recording sheet 74.

Figure 5:
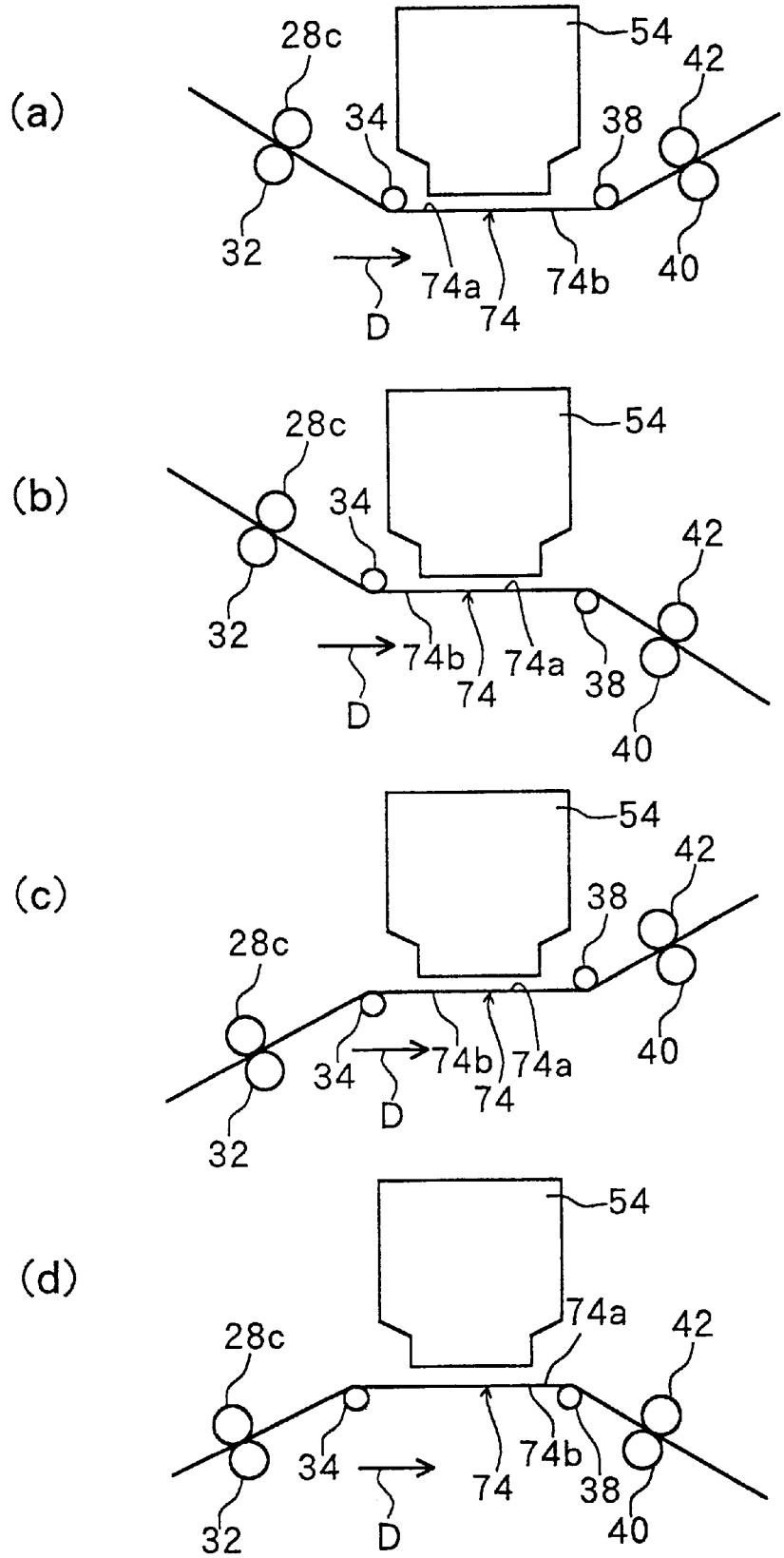
FIG. 5(*a*) is a typical illustration showing a positional relation in the event that both the first and second position control members shown in FIG. 4 press on the upside of a recording sheet.

In FIGS. 5(*a*) to 5(*d*), the same parts are denoted by the same reference numbers as those of FIG. 4.

In the positional relationship among the first position control member 34, the second position control member 38 and the recording sheet 74, there are four ways of positional relationship as shown in FIGS. 5(*a*) to 5(*d*).

FIG. 5(*a*) shows a positional relation in the event that both the first and second position control members 34 and 38 press on the upside (image surface) 74*a* of the recording sheet 74.

FIG. 5(*b*) shows a positional relation in the event that the first position control member 34 presses on the upside 74*a* of the recording sheet 74, while the second position control member 38 presses on the underside (non-image surface) 74*b* of the recording sheet 74.

FIG. 5(*c*) shows a positional relation in the event that the first position control member 34 presses on the underside 74*b* of the recording sheet 74, while the second position control member 38 presses on the upside 74*a* of the recording sheet 74.

FIG. 5(*d*) shows a positional relation in the event that both the first and second position control members 34 and 38 press on the underside 74*b* of the recording sheet 74.

According to the image forming apparatus employing an ink-jet system, or the plotter 10 as shown in FIG. 1, drying of ink after the image formation is relatively slow. Further, according to the image forming apparatus employing an ink-jet system, or the plotter 10 as shown in FIG. 1, the recording sheet 74 is pressed by the first and second position control members 34 and 38 to apply tension to the recording sheet 74 so that the cockling is suppressed. For this reason, the first and second position control members 34 and 38 are firmly in contact with the recording sheet 74. From this point of view with respect to the above-mentioned positional relations, the positional relations shown in FIGS. 5(*a*) and 5(*c*) are not suitable, since the second position control member 38 is in contact with the upside 74*a* of the recording sheet 74 immediately after the image formation and it involves a possibility such that a turbulence of images occurs. On the other hand, the positional relations shown in FIGS. 5(*b*) and 5(*d*) are deemed to be suitable, since the second position control member 38 is not in contact with the upside 74*a* of the recording sheet 74 after the image formation. In the state shown in FIG. 5(*b*), in the event that the first or second position control members 34 and 38 is adjusted in their position in accordance with thickness of the recording sheet 74, the second position control member 38 is moved in the vertical direction. On the other hand, in the state shown in FIG. 5(*d*), in the event that the first or second position control members 34 and 38 is adjusted in their position in accordance with thickness of the recording sheet 74, both the first and second position control members 34 and 38 are moved in the vertical direction.

Figure 6:
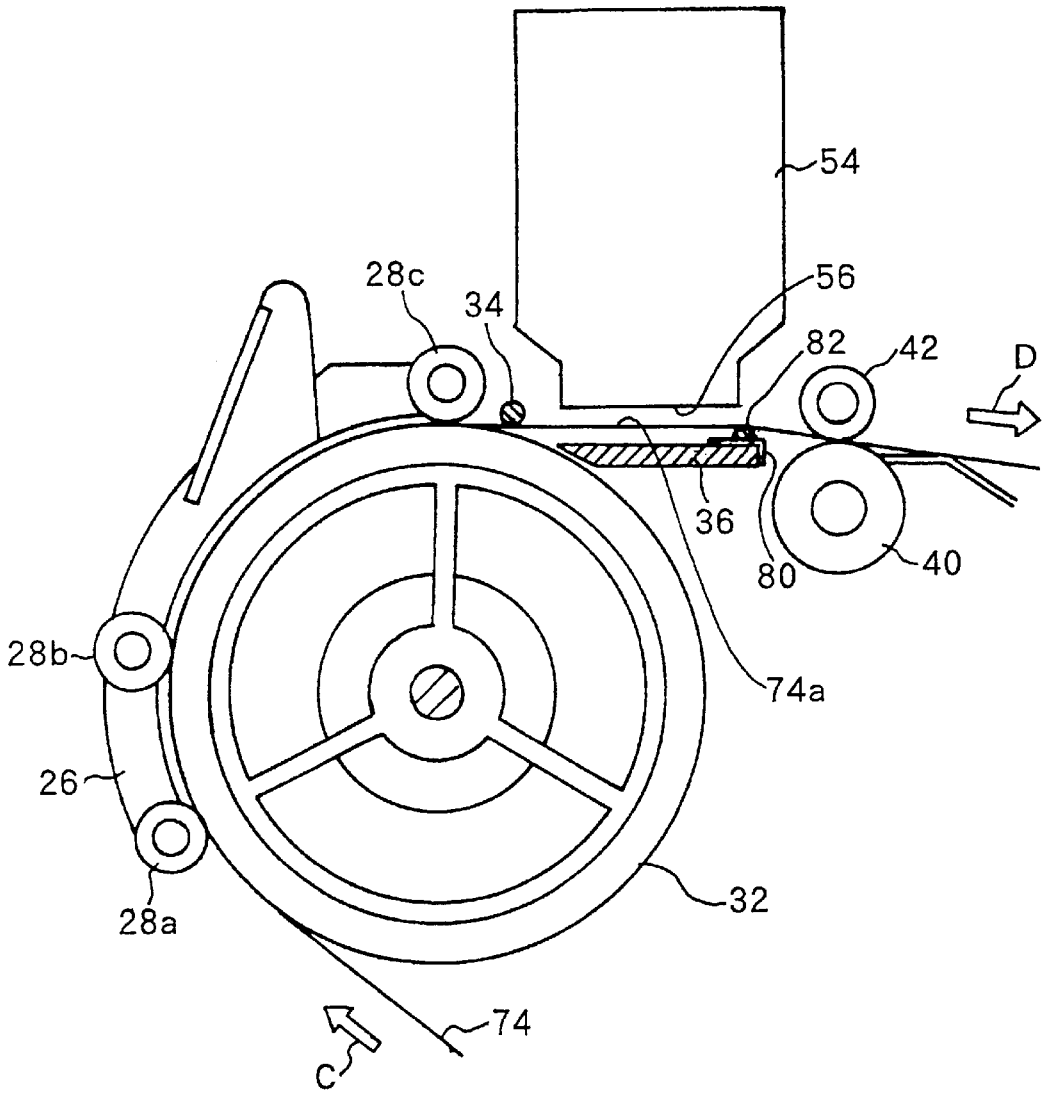
FIG. 6 is a cross-sectional view of a first position control member and a second position control member with which a plotter according to a second embodiment of an image forming apparatus employing an ink-jet system of the present invention is provided.
Figure 7:
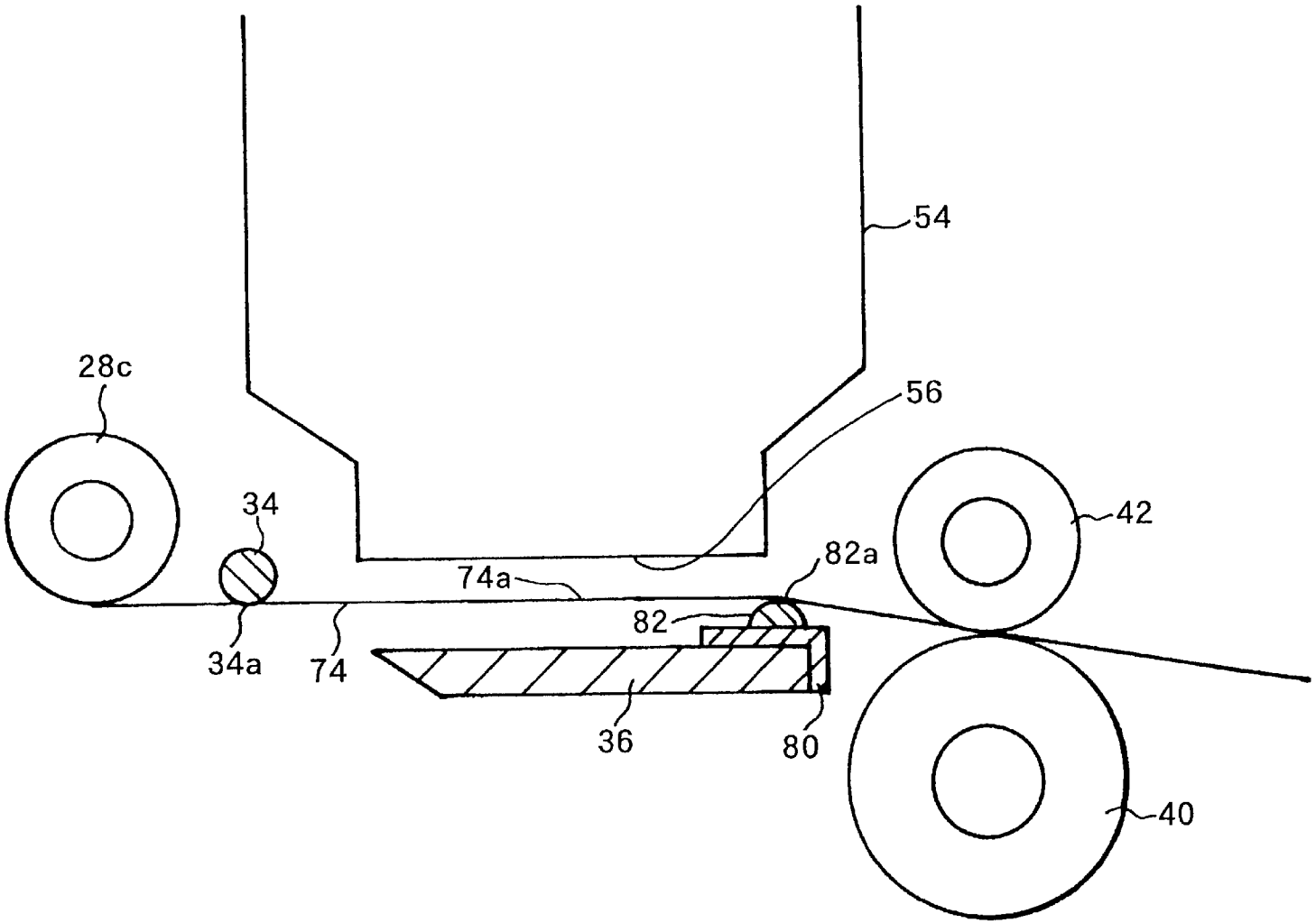
FIG. 7 is a grossly enlarged sectional view of the vicinity of the first position control member and the second position control member shown in FIG. 6.

Next there will be explained a second embodiment of the present invention with reference to FIGS. 6 and 7. An appearance of the plotter according to the second embodiment is the same as the plotter shown in FIG. 1, and also with respect to structural elements they are the similar to those of FIG. 1. Consequently, in FIGS. 6 and 7, the same parts are denoted by the same reference numbers as those of FIGS. 1 to 5.

An aspect of the plotter according to the second embodiment resides in the point that a horizontality ensuring member 80 is fixed on the print board 36 and a second position control member 82 is fixed on the horizontality ensuring member 80. Incidentally, the structure of the first position control member 34 shown in FIGS. 6 and 7 is the same as that of the first position control member 34 shown in FIGS. 2 and 4, and thus its explanation will be omitted.

The horizontality ensuring member 80 is detachably fixed on a portion of the print board 36, which portion is located at the downward stream end with respect to the recording sheet conveyance direction. The horizontality ensuring member 80 adjusts a position of the second position control member 82 so that a portion of the recording sheet 74, which portion is located at the image forming area, is kept parallel to the ink ejection surface 56. The second position control member 82 is detachably fixed on the portion of the print board 36, which portion is located at the downward stream end with respect to the recording sheet conveyance direction, through the horizontality ensuring member 80. Consequently, in the event that the portion of the recording sheet 74, which portion is located at the image forming area, is not kept parallel to the ink ejection surface 56 owing to changing thickness of the recording sheet 74, the use of a different size of horizontality ensuring member 80 makes it possible that the portion of the recording sheet 74, which portion is located at the image forming area, is kept parallel to the ink ejection surface 56. The second position control member 82 is a section "D"-like configuration of line-shaped member extending in an arrow B direction (the vertical direction with respect to the sheet faces of FIGS. 6 and 7, cf. FIG. 2), and is in contact with the horizontality ensuring member 80 on its flat face. A portion of the second position control member 82, which portion presses the recording sheet 74, is given by a curved surface 82*a*. This feature makes it possible to ensure a smooth conveyance for the recording sheet 74 and the linearity of the second position control member 82. In a similar fashion to that of the first position control member 34, the second position control member 82 is also made of a mold material, a sheet metal, etc., since the linearity is required also for the second position control member 82. It is noted that according to experiments, a round bar made of steel, in 5 mm in diameter is preferable.

Also in the event that the horizontality ensuring member 80 and the second position control member 82 are used, in a similar fashion to that of the first embodiment, the guide rail 60 (cf. FIG. 3), the first position control member 34 and the second position control member 82 are arranged to be parallel to one another. Thus, a recording sheet, which is conveyed through supporting by the driving roller 32 and the sheet conveyance roller 28*c*, is controlled in its position through being pressed by a curved surface 34*a* of the first position control member 34 and through being pressed by the curved surface 82*a* of the second position control member 82. This feature makes it possible, as shown in FIG. 7, to maintain the interval between the ink ejection surface 56 and the portion 74*a* of the recording sheet 74 constant, the portion 74*a* being located at the image forming area, regardless of a moving position of the print head 54, thereby obtaining a good quality of image. Further, also in the event that a printing is performed on a large-sized recording sheet, it is possible to ensure flatness of the recording sheet.

Incidentally, it is preferable that the interval between the face of the recording sheet located at the image forming area and the print heads 54 is 1 to 2 mm, and the interval between the recording sheet and the print board 36 is at least 2 to 5 mm. The first position control member 34 and the second position control member 82 may be adjusted vertically in their position in accordance with thickness of the recording sheet 74, so that a good image can be obtained even if thickness of the recording sheet 74 is varied.

Figure 8:
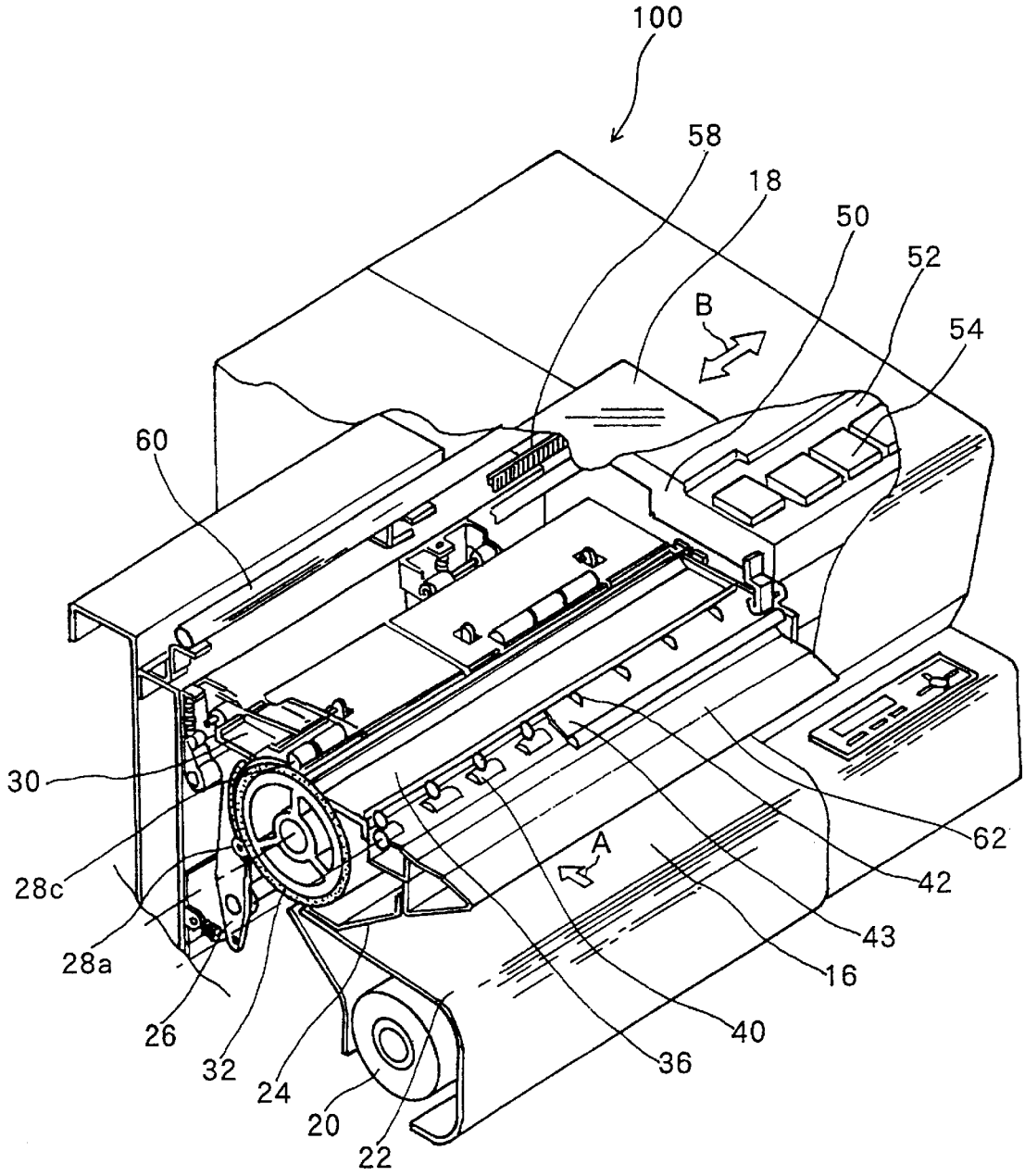
FIG. 8 is a perspective view of a path from an insertion of a recording sheet to a discharge of the recording sheet in a plotter according to a third embodiment of an image forming apparatus employing an ink-jet system of the present invention, the plotter being shown on an open basis for the purpose of better understanding.
Figure 9:
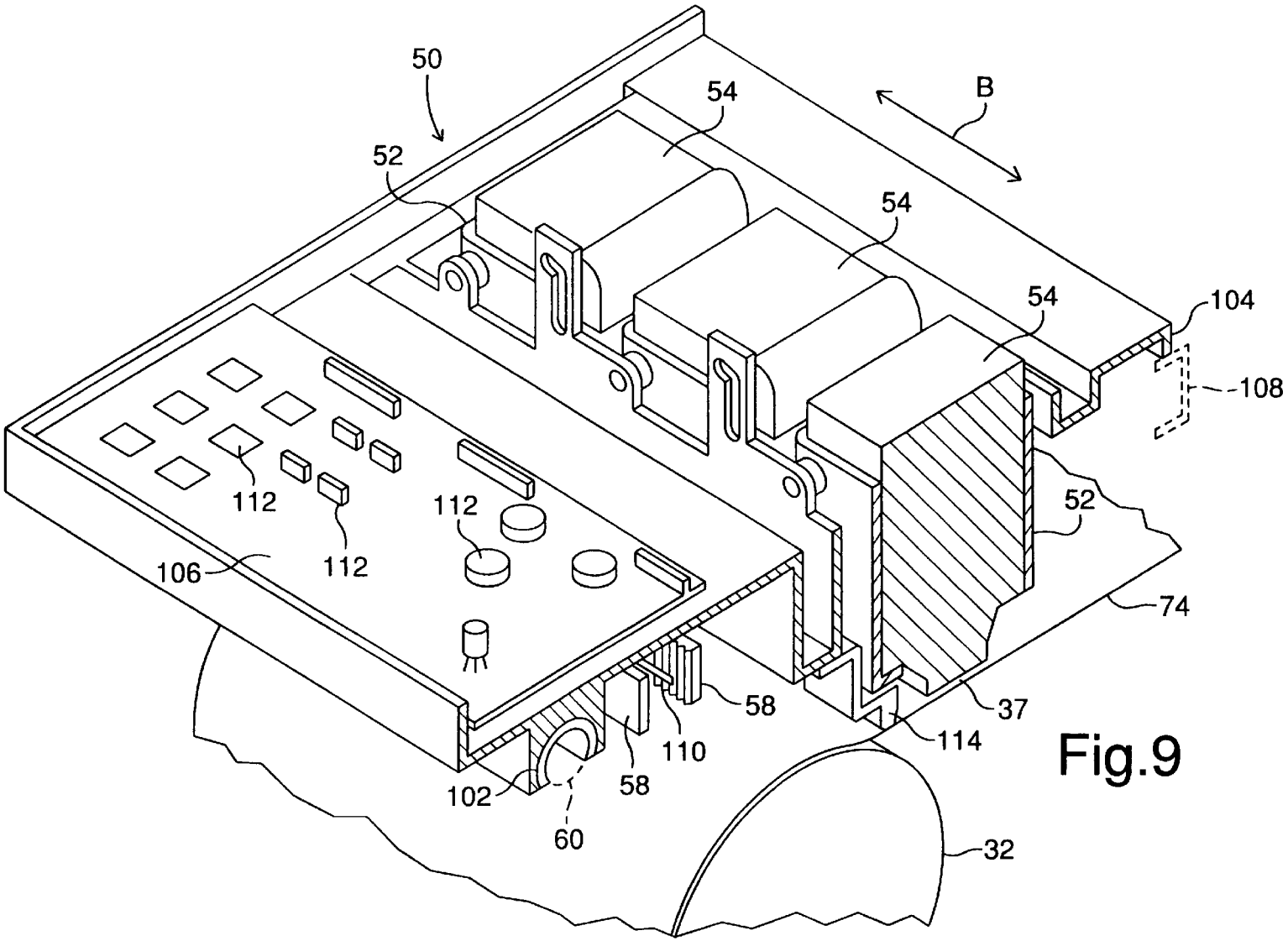
FIG. 9 is a perspective view of the plotter shown in FIG. 8 but cutting off a carriage.
Figure 10:
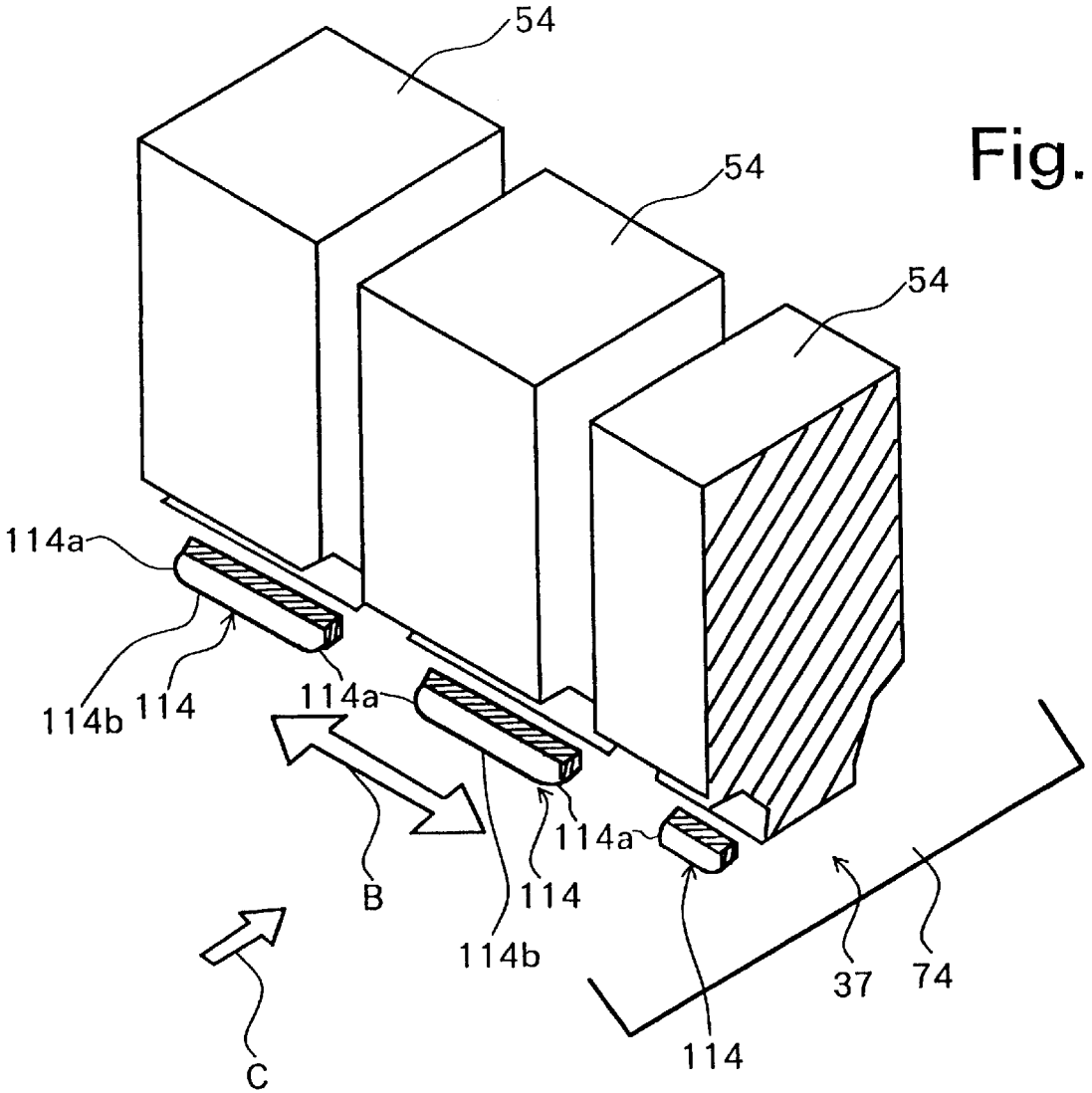
FIG. 10 is a perspective view of a configuration of parts facing a recording sheet, of a recording medium flotation prevention member shown in FIG. 9.

Next there will be explained a third embodiment of the present invention with reference to FIGS. 8 to 10. An appearance of the plotter according to the third embodiment is the same as the plotter shown in FIG. 1, and also with respect to structural elements they are the similar to those of FIG. 1. Consequently, in FIGS. 8 to 10, the same parts are denoted by the same reference numbers as those of FIGS. 1 to 5.

First, referring to FIG. 8, there will be explained a conveyance path of recording sheets and a printing (image forming) process in the plotter according to the third embodiment.

A plotter 100 may perform a printing selectively either on a sheet-like shaped recording sheet (a cut sheet) inserted from the recording sheet insertion inlet 16 and a recording sheet (a rolled sheet) 20 wound as a roll. Here, there will be described a conveyance path for cut sheets inserted from the recording sheet insertion inlet 16.

For example, a large-sized cut sheet is regularly placed on the cover 22 for the rolled sheet 20 and is inserted into the recording sheet insertion inlet 16 from an arrow A direction. The cut sheet inserted passes between the cover 22 and an upper guide 24, and reaches the upper portion (an example of an image forming area referred to in the present invention) 37 of the print board 36, while being supported by both the sheet conveyance roller 28*a* rotatably fixed on th lower conveyance roller supporting plate 26 and the sheet conveyance roller 28*c* rotatably fixed on the upper conveyance roller supporting plate 30, and the driving roller 32. The cut sheet, which has passed through the upper side of the print board 36, is discharged while being supported by the discharge roller 40 and the spurs 42 which is located at the upper side of the discharge roller 40. The spurs 42 are rotatably fixed on a spur plate 43.

The plotter 100 has the carriage 50 which reciprocates in an arrow B direction. The carriage 50 has a head holder 52 on which four print heads 54 accommodating four types of color inks (for example, cyan, magenta, yellow and black of inks), respectively, are mounted. The carriage 50 is fixed on a belt 58 which is coupled with a driving motor (not illustrated). The belt 58 reciprocates in an arrow B direction in accordance with a forward-backward rotation of the driving motor. Reciprocation of the belt 58 in the arrow B direction causes the carriage 50 to reciprocate in the arrow B direction in accordance with the guide rail 60.

A cut sheet is intermittently conveyed in a direction (an example of the recording sheet conveyance direction referred to in the present invention) perpendicular to the arrow B direction. When an image is formed on the cut sheet, the cut sheet is temporarily stopped, and while the carriage 50 reciprocates in the arrow B direction, ink is ejected from the print heads 54 in accordance with image information applied to the print heads 54 to form an a band of image on a portion, of the cut sheet, which portion is located at the image forming area 37. Thereafter, the cut sheet is conveyed by a predetermined length so that a subsequent band of image is formed on the image forming area 37. This operation is repeated throughout the overall length of the cut sheet. Thus, a color image is formed on the cut sheet. The cut sheet on which the color image is formed is discharged along the discharge guide 62 while being supported by the discharge roller 40 and the spurs 42.

Next, there will be explained details of the carriage 50 shown in FIG. 8 with reference to FIG. 9.

The carriage 50 comprises the head holder 52 for detachably holding four print heads 54, a bearing 102 and a slider 104 for reciprocating the carriage 50 in the arrow B direction, and an electric equipment unit 106 for controlling the print heads 54 in accordance with image information.

The bearing 102 is of the shape of a horseshoe, and is disposed downward of the electric equipment unit 106. The guide rail 60 is fitted into the bearing 102 so that the carriage 50 is guided by the guide rail 60. The slider 104 is in contact with a sub-rail 108 (in FIG. 8 it is omitted). When the carriage 50 reciprocates in the arrow B direction, the carriage 50 is guided by the guide rail 60 and the sub-rail 108, while a linear sensor (not illustrated), which is mounted on the under portion of the carriage 50, reads the scale of a linear scale 110. Thus, the carriage 50 may reciprocate while exactly detecting its position.

The electric equipment unit 106 is disposed near the print heads 54 so as to be hard affected by noises, and loads thereon various types of electronic parts. A recording medium floating prevention member 114 is disposed for each print head 54 in the more upward stream with respect to the recording sheet conveyance direction than the ink ejection outlet of the associated print head 54 and in the vicinity of the ink ejection outlet. The recording medium floating prevention member 114 is fixed on the carriage 50, and is closer to the recording sheet 74 as compared with the print head 54. There is ensured a gap between the recording medium floating prevention member 114 and the recording sheet 74. The recording medium floating prevention member 114 is made of polyoxymethylene or fluororesin, and is tough and low in coefficient of friction to recording sheets. Consequently, as will be described later, even if a convex portion of the recording sheet 74 is in contact with the recording medium floating prevention member 114, there occurs no frictional force that is an obstacle to an image formation and a conveyance of the recording sheet 74.

According to the plotter 100, in the event that ink is ejected from the ink ejection outlets of the print heads 54 to form an image on the recording sheet 74, it happens that the above-mentioned cockling occurs and whereby unevenness is formed on the recording sheet 74. The degree of this unevenness is varied in accordance with a sheet quality of the recording sheet 74 and a print duty (an amount of ink per unit area). In the event that the degree of the unevenness is great, since a convex portion, which grows up to the image forming area 37, is pressed by the recording medium floating prevention member 114, there is no case where the convex portion is in contact with the print heads 54. Consequently, it is possible to prevent damages of the print heads and adhesion of sheet powders on the ink ejection outlets, and thereby improving an image quality since ink is always normally ejected.

Next, referring to FIG. 10, there will be explained a configuration of parts facing a recording sheet, of the recording medium flotation prevention member 114.

Of the recording medium flotation prevention member 114, each of ends 114*a* in the arrow B direction (longitudinal direction) is rounded and smoothed. Further, of the recording medium flotation prevention member 114, each of ends 114*b* in the arrow C direction (recording sheet conveyance direction) is also rounded and smoothed. In this manner, of the recording medium flotation prevention member 114, the portions facing the recording sheet 74 are smoothly formed. Consequently, even if an edge of the recording sheet 74 in the width direction of the recording sheet 74 is curled up, it does not happen, when the carriage 50 reciprocates in the arrow B direction, that the curled up portion of the recording sheet 74 catches the recording medium flotation prevention member 114 and as a result the recording sheet 74 is broken.

Incidentally, according to the present embodiment, the recording medium flotation prevention member 114 is formed for each print head 54. It is acceptable, however, that a single recording medium flotation prevention member, which extends in the arrow B direction, is formed on the carriage 50 in a straight line. Further, according to the present embodiment, the recording medium flotation prevention member 114 is formed on the carriage 50. It is acceptable, however, that the recording medium flotation prevention member is formed on the print heads 54. This arrangement makes it easy to form the recording medium flotation prevention member at a place nearer to the ink ejection outlets. Further, in this case, even if an arrangement of a plurality of print heads 54 is somewhat out of line, it is possible to readily arrange the recording medium flotation prevention member in accordance with the arrangement of the print heads 54.

Industrial Applicability

According to the first image forming apparatus employing an ink-jet system of the present invention, of the recording sheet in the way of conveyance, a portion located at the image forming area is stretched, and an interval between this portion and the ink ejection surface is kept at a predetermined interval. Thus, even if ink ejected from the ink ejection outlets is absorbed into the recording sheet, so that a fiber of the recording sheet expands, no unevenness is formed on the recording sheet. Therefore, it is possible to suppress the cocking. Further, a surface of the recording sheet located at the image forming area assumes a plane through being stretched by the first position control member and the second position control member. This feature makes it possible, even if a large-sized recording sheet is used, to maintain the interval between the surface of the recording sheet located at the image forming area and the ink ejection surface constant, and thus it is possible to expect a good printing.

Here, in the event that both the first position control member and the second position control member extend in a predetermined direction in which the ink ejection surface reciprocates, it means that the recording sheet is pressed in the width direction of the recording sheet. Thus, it is possible to more exactly stretch the recording sheet, and thereby suppressing the cockling.

In the event that at least one of the first position control member and the second position control member is a line-shaped one spread in a predetermined direction, it does not occupy a great deal of space, and thus it is permitted to place the position control member approaching the ink ejection surface. This makes it possible to shorten an interval between the first position control member and the second position control member and whereby the surface of the recording sheet located at the image forming area assumes a greater precision of plane. Thus, it is possible to obtain a good image. Further, since at least one of the first position control member and the second position control member is spread in a predetermined direction, it is possible, even if they becomes longer owing to environmental temperature and heat, to ensure its linearity and whereby the surface of the recording sheet located at the image forming area assumes a plane.

Further, according to the second image forming apparatus employing an ink-jet system of the present invention, a position in which the first conveyance member supports the recording sheet is located at a position which is higher than the first position control member, and a position in which the second conveyance member supports the recording sheet is located at a position which is lower than the second position control member or the same height as the second position control member. This feature makes it easy to ensure flatness of the surface of the recording sheet located at the image forming area.

Here, in the event that the first position control member presses, of both the surfaces of the recording sheet, a surface facing the ink ejection surface, and the second position control member presses, of both the surfaces of the recording sheet, a surface opposite to the surface facing the ink ejection surface, the second position control member is not in contact with a surface of the recording sheet on which an image has been formed. This feature makes it possible to prevent a turbulence of images due to the contact of the second position control member with the surface of the recording sheet.

Furthermore, according to the third image forming apparatus employing an ink-jet system of the present invention, positions in which the first conveyance member and the second conveyance member support the recording sheet, respectively, are located at positions which are lower than the first position control member and the second position control member, respectively. This feature makes it easy to ensure flatness of the surface of the recording sheet located at the image forming area.

Here, in the event that both the first position control member and the second position control member press, of both the surfaces of the recording sheet, a surface opposite to the surface facing the ink ejection surface, the second position control member is not in contact with a surface of the recording sheet on which an image has been formed. This feature makes it possible to prevent a turbulence of images due to the contact of the second position control member with the surface of the recording sheet.

In the event that at least one of the first position control member and the second position control member is a line-shaped one, it is permitted to place the fine line-like shaped position control member approaching the ink ejection surface. This makes it possible to more improve flatness of the recording sheet and thereby obtaining a high-definition of image.

Still further, according to the fourth image forming apparatus employing an ink-jet system of the present invention, of the recording sheet in the way of conveyance, a portion located at the image forming area is stretched, and an interval between this portion and the ink ejection surface is kept at a predetermined interval. Thus, even if ink ejected from the ink ejection outlets is absorbed into the recording sheet, so that a fiber of the recording sheet expands, no unevenness is formed on the recording sheet. Therefore, it is possible to suppress the cocking. Further, a surface of the recording sheet located at the image forming area assumes a plane through being stretched by the first position control member and the second position control member. This feature makes it possible, even if a large-sized recording sheet is used, to maintain the interval between the surface of the recording sheet located at the image forming area and the ink ejection surface constant, and thus it is possible to expect a good printing. Further, the use of the horizontality ensuring member detachably fixed on the second position control member makes it possible to adjust a position of the second position control member so that a portion of the recording sheet, which portion is located at the image forming area, is kept parallel to the ink ejection surface. Consequently, in the event that the portion of the recording sheet, which portion is located at the image forming area, is not kept parallel to the ink ejection surface owing to changing thickness of the recording sheet, the use of the horizontality ensuring member makes it possible that the portion of the recording sheet, which portion is located at the image forming area, is kept parallel to the ink ejection surface.

Here, in the event that each of the first position control member and the second position control member has a curved surface pressing the recording sheet, it is possible to ensure a smooth conveyance for the recording sheet.

Still furthermore, according to the fifth image forming apparatus employing an ink-jet system of the present invention, even if a convex portion is formed on the recording sheet at the lower portion of the recording medium floating prevention member or at the upper stream with respect to the recording sheet conveyance direction, the convex portion is pressed, and thus the convex portion is not in contact with the print head. This feature makes it possible to prevent the print head from being damages and to prevent sheet powders from adhering to the ink ejection outlets, and thereby improving the image quality since ink is ejected normally.

Here, in the event that a portion of the recording medium floating prevention member, which portion faces the recording sheet, is formed with smoothness, when the recording medium floating prevention member is in contact with the recording sheet, there happens no such a matter that the recording sheet catches the recording medium flotation prevention member and as a result the recording sheet is broken.

Further, in the event that the recording medium floating prevention member is made of polyoxymethylene or fluororesin, it is low in coefficient of friction to recording sheets. Consequently, even if a convex portion of the recording sheet is in contact with the recording medium floating prevention member, there occurs no frictional force that is an obstacle to an image formation and a conveyance of the recording sheet.

Furthermore, in the event that the recording medium floating prevention member is formed on the print head, it is more easy to form the recording medium floating prevention member nearer the ink ejection outlets. In addition, even if an arrangement of a plurality of print heads is somewhat out of line, it is possible to readily arrange the recording medium floating prevention member in accordance with the arrangement.

Still further, in the event that the recording medium floating prevention member is formed on the carriage, there is no need to form the recording medium floating prevention member for each print head, and thereby reducing the cost.

What is claimed is:

1. An image forming apparatus employing an ink-jet system wherein a carriage, which has an ink ejection surface on which a plurality of ink ejection outlets each ejecting ink are formed, is reciprocated in a predetermined direction, while a recording sheet is conveyed in a direction intersecting the predetermined direction, and ink is ejected from the ink ejection outlets onto a portion of the recording sheet, which portion is located at an image forming area in front of the ink ejection surface, in accordance with image information to form an image, said image forming apparatus comprising:

a first conveyance member for conveying the recording sheet while supporting the recording sheet, said first conveyance member being disposed at an upper stream with respect to a recording sheet conveyance direction than the image forming area;

a second conveyance member for conveying the recording sheet while supporting the recording sheet, said second conveyance member being disposed at a down stream with respect to the recording sheet conveyance direction than the image forming area;

a first position control member for controlling a position of the recording sheet by pressing either one of both surfaces of the recording sheet, said first position control member being disposed between said first conveyance member and the image forming area; and a second position control member for controlling a position of the recording sheet by pressing either one of both surfaces of the recording sheet, so that the portion of the recording sheet, which portion is located at the image forming area, is stretched in cooperation with said first position control member and an interval between said portion of the recording sheet and the ink ejection surface is maintained at a predetermined distance, said second position control member being disposed between said image forming area and said second conveyance member.

2. An image forming apparatus employing an ink-jet system according to claim 1 wherein both said first position control member and said second position control member extend in the predetermined direction.

3. An image forming apparatus employing an ink-jet system according to claim 1 wherein at least one of said first position control member and said second position control member is a line-shaped member spread in the predetermined direction.

4. An image forming apparatus employing an ink-jet system wherein a carriage, which has an ink ejection surface on which a plurality of ink ejection outlets each ejecting ink are formed, is reciprocated in a predetermined direction, while a recording sheet is conveyed in a direction intersecting the predetermined direction, and ink is ejected from the ink ejection outlets onto a portion of the recording sheet, which portion is located at an image forming area in front of the ink ejection surface, in accordance with image information to form an image, said image forming apparatus comprising:

a first conveyance member for conveying the recording sheet while supporting the recording sheet, said first conveyance member being disposed at an upper stream with respect to a recording sheet conveyance direction than the image forming area;

a second conveyance member for conveying the recording sheet while supporting the recording sheet, said second conveyance member being disposed at a down stream with respect to the recording sheet conveyance direction than the image forming area;

a first position control member for controlling a position of the recording sheet by pressing either one of both surfaces of the recording sheet, said first position control member being disposed between said first conveyance member and the image forming area; and a second position control member for controlling a position of the recording sheet by pressing either one of both surfaces of the recording sheet, so that the portion of the recording sheet, which portion is located at the image forming area, is stretched in cooperation with said first position control member and an interval between said portion of the recording sheet and the ink ejection surface is maintained at a predetermined distance, said second position control member being disposed between said image forming area and said second conveyance member, wherein a position in which the first conveyance member supports the recording sheet is located at a position which is higher than the first position control member, and a position in which the second conveyance member supports the recording sheet is located at a position which is lower than the second position control member or the same height as the second position control member.

5. An image forming apparatus employing an ink-jet system according to claim 4 wherein the first position control member presses, of both the surfaces of the recording sheet, a surface facing the ink ejection surface, and the second position control member presses, of both the surfaces of the recording sheet, a surface opposite to the surface facing the ink ejection surface.

6. An image forming apparatus employing an ink-jet system wherein a carriage, which has an ink ejection surface on which a plurality of ink ejection outlets each ejecting ink are formed, is reciprocated in a predetermined direction, while a recording sheet is conveyed in a direction intersecting the predetermined direction, and ink is ejected from the ink ejection outlets onto a portion of the recording sheet, which portion is located at an image forming area in front of the ink ejection surface, in accordance with image information to form an image, said image forming apparatus comprising:

a first conveyance member for conveying the recording sheet while supporting the recording sheet, said first conveyance member being disposed at an upper stream with respect to a recording sheet conveyance direction than the image forming area;

a second conveyance member for conveying the recording sheet while supporting the recording sheet, said second conveyance member being disposed at a down stream with respect to the recording sheet conveyance direction than the image forming area;

a first position control member for controlling a position of the recording sheet by pressing either one of both surfaces of the recording sheet, said first position control member being disposed between said first conveyance member and the image forming area; and a second position control member for controlling a position of the recording sheet by pressing either one of both surfaces of the recording sheet, so that the portion of the recording sheet, which portion is located at the image forming area, is stretched in cooperation with said first position control member and an interval between said portion of the recording sheet and the ink ejection surface is maintained at a predetermined distance, said second position control member being disposed between said image forming area and said second conveyance member, wherein positions in which the first conveyance member and the second conveyance member support the recording sheet, respectively, are located at positions which are lower than the first position control member and the second position control member, respectively.

7. An image forming apparatus employing an ink-jet system according to claim 6 wherein both the first position control member and the second position control member press, of both the surfaces of the recording sheet, a surface opposite to the surface facing the ink ejection surface.

8. An image forming apparatus employing an ink-jet system according to any of claims 4 to 7 wherein at least one of said first position control member and said second position control member is a fine line-like shaped one.

9. An image forming apparatus employing an ink-jet system wherein a carriage, which has an ink ejection surface on which a plurality of ink ejection outlets each ejecting ink are formed, is reciprocated in a predetermined direction, while a recording sheet is conveyed in a direction intersecting the predetermined direction, and ink is ejected from the ink ejection outlets onto a portion of the recording sheet, which portion is located at an image forming area in front of the ink ejection surface, in accordance with image information to form an image, said image forming apparatus comprising:

a first conveyance member for conveying the recording sheet while supporting the recording sheet, said first conveyance member being disposed at an upper stream with respect to a recording sheet conveyance direction than the image forming area;

a second conveyance member for conveying the recording sheet while supporting the recording sheet, said second conveyance member being disposed at a down stream with respect to the recording sheet conveyance direction than the image forming area;

a line shaped configuration first position control member for controlling a position of the recording sheet by pressing either one of both surfaces of the recording sheet, said first position control member being disposed between said first conveyance member and the image forming area;

a line shaped configuration second position control member for controlling a position of the recording sheet by pressing either one of both surfaces of the recording sheet, so that the portion of the recording sheet, which portion is located at the image forming area, is stretched in cooperation with said first position control member and an interval between said portion of the recording sheet and the ink ejection surface is maintained at a predetermined distance, said second position control member being disposed between said image forming area and said second conveyance member and;

a horizontality ensuring member for adjusting a position of the second position control member so that a portion of the recording sheet, which portion is located at the image forming area, is kept parallel to the ink ejection surface, said horizontality ensuring member being detachably fixed on said second position control member.

10. An image forming apparatus employing an ink-jet system according to claim 9 wherein each of said first position control member and said second position control member has a curved surface pressing the recording sheet.

11. An image forming apparatus employing an ink-jet system comprising a print head having ink ejection outlets each for ejecting ink, and a carriage on which said print head is mounted, said carriage reciprocating in a predetermined direction, wherein a recording sheet is fed to an image forming area facing the ink ejection outlets, and ink is ejected from the ink ejection outlets onto the recording sheet, while said carriage reciprocates in the predetermined direction, said image forming apparatus comprising:

a recording medium floating prevention member disposed in the more upward stream with respect to a recording sheet conveyance direction than the ink ejection outlet and in the vicinity of the ink ejection outlet, said recording medium floating prevention member being closer to the recording sheet as compared with the print head.

12. An image forming apparatus employing an ink-jet system according to claim 11, wherein the recording medium floating prevention member is made of polyoxymethylene or fluororesin.

13. An image forming apparatus employing an ink-jet system according to any of claim 11 or 12, wherein the recording medium floating prevention member is formed on the print head.

14. An image forming apparatus employing an ink-jet system according to any of claim 11 or 12, wherein the recording medium floating prevention member is formed on the carriage.

* * * * *